US006148460A

United States Patent [19]

Fried et al.

[11] Patent Number: 6,148,460

[45] Date of Patent: Nov. 21, 2000

[54] MASSAGE AND THERAPEUTIC BED EXTENSION DEVICE

[76] Inventors: Steven J. Fried; David Benjamin Fried, both of 11619 NE. 36th Ct., Vancouver, Wash. 98686

[21] Appl. No.: 09/257,658

[22] Filed: Mar. 2, 1999

[51] Int. Cl.[7] ..... A47C 31/00

[52] U.S. Cl. ..... 5/661; 5/658; 5/622; 5/643

[58] Field of Search ..... 5/622, 636, 638, 5/643, 658, 659, 661

[56] References Cited

U.S. PATENT DOCUMENTS

| | | | |
|---|---|---|---|
| D. 295,349 | 4/1988 | Mueller . | |
| D. 304,614 | 11/1989 | Guttormsen . | |
| D. 403,772 | 1/1999 | Fanuzzi . | |
| 3,005,212 | 10/1961 | Barnhill | 5/661 X |
| 4,230,100 | 10/1980 | Moon . | |
| 4,333,638 | 6/1982 | Gillotti . | |
| 4,404,966 | 9/1983 | Hartman . | |
| 4,732,141 | 3/1988 | Steffensmeier . | |
| 4,856,497 | 8/1989 | Westphal . | |
| 4,973,034 | 11/1990 | Michele . | |
| 5,009,170 | 4/1991 | Spehar . | |
| 5,177,823 | 1/1993 | Riach | 5/636 |

*Primary Examiner*—Lynne H. Browne
*Assistant Examiner*—Fredrick Conley
*Attorney, Agent, or Firm*—Robert D. Varitz, PC

[57] ABSTRACT

A bed extension device for use with a conventional bed having a mattress and box springs includes a head support element having a generally planar top portion and a side portion, wherein the top portion includes a hole therein and wherein the side portion is joined to the top portion at a substantially right angle; an insert element having a horizontal portion for insertion between the mattress and the box springs and a vertical portion extending at a substantially right angle therefrom; and a fastener for securing the side portion of the head support element to the vertical portion of the insert element to provide a desired alignment between the upper surface of the mattress and the top portion.

12 Claims, 2 Drawing Sheets

MASSAGE AND THERAPEUTIC BED EXTENSION DEVICE

FIELD OF THE INVENTION

This invention relates to massage therapy devices, and specifically to an extension which may be used with a conventional bed to facilitate massage therapy.

BACKGROUND OF THE INVENTION

The growing interest in touch, particularly in both therapeutic and non-therapeutic massage, has led to a vast increase in the number of persons learning and practicing massage in their homes. There has also been a significant increase in the numbers of licensed massage therapists (LMTs) and chiropractors as alternate forms of medical treatment have become more acceptable. Increases in stress-related injuries, from jobs, sports and general life activities, have increased the demand for massage therapy. While many LMTs provide services from clinics, health clubs, etc., others provide mobile services, making house and office calls.

It would be a benefit to be able to provide a simple, yet effective means of facilitating massage at home. The only options currently available for a massage provider is to purchase an expensive and cumbersome massage table, or to simply have their patient lie on a bed or on the floor. The second option is certainly less expensive, but is deficient because, in a face down position, the patient cannot breathe easily, and does not maintain proper body, neck and spine alignment.

A number of devices are known which have been disclosed to facilitate massage therapy. U.S. Pat. No. 4,230,100, to Moon, granted Oct. 28, 1980, discloses a chiropractic table having individually adjustable segments.

U.S. Pat. No. 4,333,638 to Gillotti, granted Jun. 8, 1982, discloses a foldable massage and therapeutic body work table having a removable headrest.

U.S. Pat. No. 4,404,966 to Hartman, granted Sep. 20, 1983, discloses a removable headrest for a chiropractic device having a cushion for a patient's head.

U.S. Pat. No. 4,732,141 to Steffensmeier, granted Mar. 22, 1988, discloses a chiropractic table with swingable section adjustable to treat specific spinal disorders.

U.S. Pat. No. 4,856,497 to Westphal, granted Aug. 15, 1989, discloses a portable collapsible treatment table with drop sections and an adjustable headrest.

U.S. Pat. No. 4,973,034 to Michele, granted Nov. 27, 1990, describes a massage table with abdominal hole for pregnant women.

U.S. Pat. No. 5,009,170 to Spehar, granted Apr. 23, 1991, discloses a portable body massage table having an orifice for a patient's head.

U.S. Pat. No. D 295,349 to Mueller, granted Apr. 26, 1988, discloses a collapsible portable massage table having an adjustable headrest.

U.S. Pat. No. D 304,614 to Guttorsmen, granted Nov. 14, 1989, discloses a bench for physio-therapeutical treatment having an adjustable headrest with a cutout therein.

U.S. Pat. No. D 403,772 to Fanuzzi, granted Jan. 5, 1999 discloses a combined salon and massage table having a contoured headrest.

None of the prior art devices solve the problem of using a conventional bed as a massage table wherein it is necessary to support the patients head.

SUMMARY OF THE INVENTION

A bed extension device for use with a conventional bed having a mattress and box springs includes a head support element having a generally planar top portion and a side portion, wherein the top portion includes a hole therein and wherein the side portion is joined to the top portion at a substantially right angle; an insert element having a horizontal portion for insertion between the mattress and the box springs and a vertical portion extending at a substantially right angle therefrom; and a fastener for securing the side portion of the head support element to the vertical portion of the insert element to provide a desired alignment between the upper surface of the mattress and the top portion.

An object of the invention is to provide a bed extension device which will facilitate massage therapy.

Another object of the invention is to provide a bed extension device which may be used with mattresses having different thicknesses.

A further object of the invention is to provide a bed extension device that may be transported in a compact manner.

Another object of the invention is to provide a support wherein a face rest extends beyond a mattress upper surface and is adjustable to keep the patient's neck and spine in alignment, thus optimizing the effectiveness and comfort of the massage.

Still another object of the invention is to provide a support having a face hole surrounded by a cushioned, upholstered surface to provide a comfortable cradle for the face to allow breathing space for the person receiving the massage, while simultaneously protecting the face from undue and uncomfortable pressure.

Another object of the invention is to provide a support that provides the features and benefits of a full massage table for optimal body alignment and easy, comfortable breathing, that is easy to transport and use and is economical to manufacture.

These and other objects and advantages of the invention will become more fully apparent as the description which follows is read in conjunction with the drawings.

DETAILED DESCRIPTION OF THE PREFERRED EMBODIMENT

Figure 1:
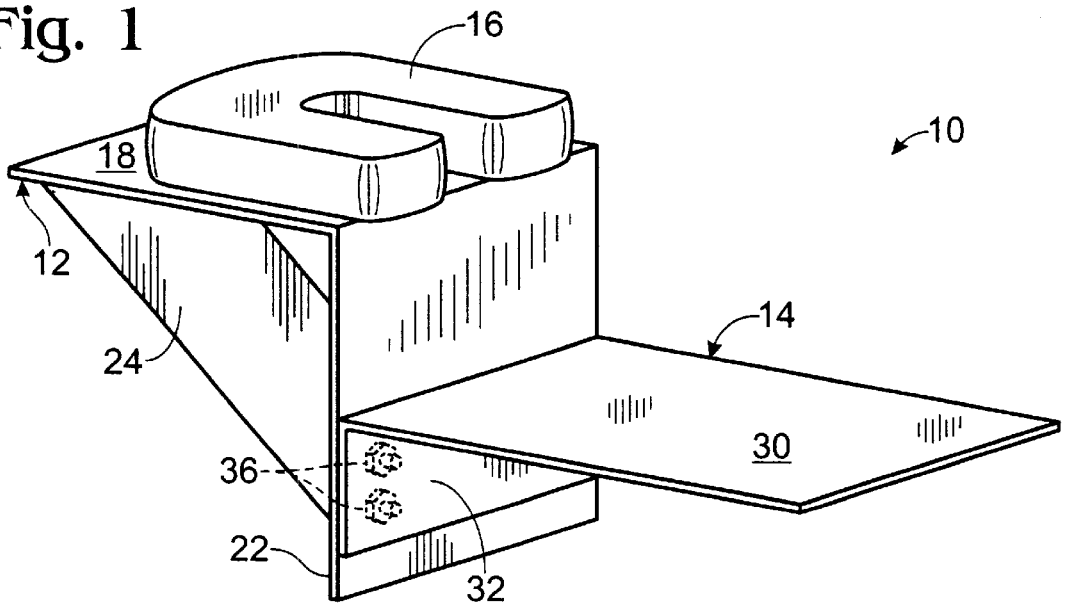
FIG. 1 is a perspective view of the bed extension device of the invention.
Figure 2:
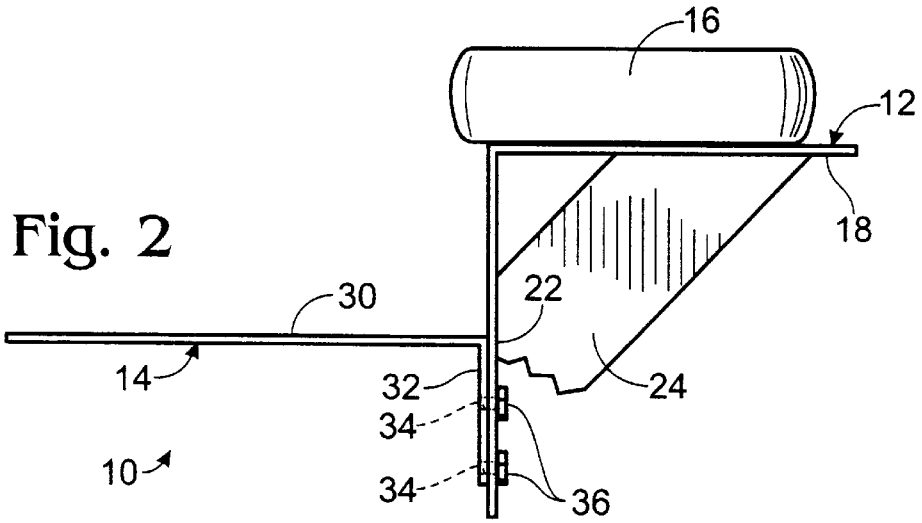
FIG. 2 is a side elevation of the device of FIG. 1.

Referring now to FIGS. 1 and 2, the bed extension devise (BED) of the invention is shown generally at 10. BED 10 includes a head support element 12, an insert element 14 and a cushion 16.

Figure 3:
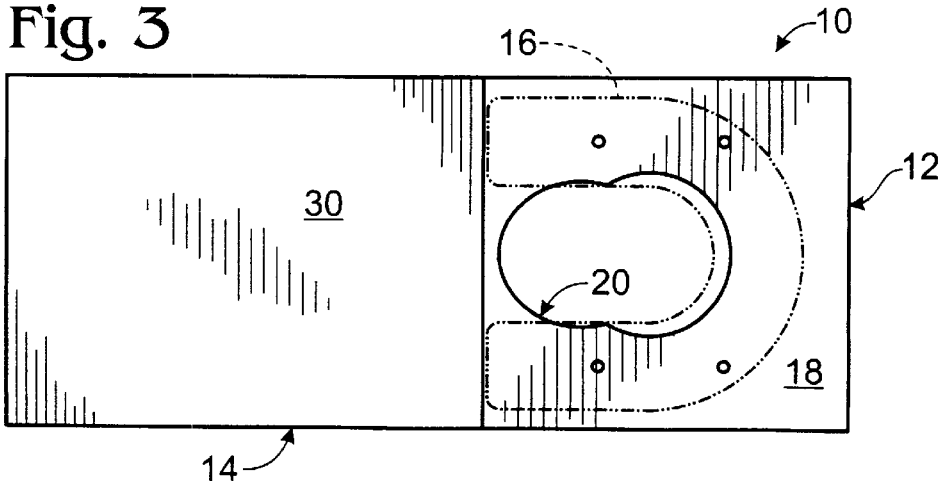
FIG. 3 is a partial top plan view of the device of FIG. 1.

Head support element 12 includes a top portion 18, having, and now referring briefly to FIG. 3, a hole 20 therein. Top portion 18, also referred to herein as a first parallel surface, is a substantially flat surface, in the preferred embodiment, and hole 20 is centered thereon. Hole 20 generally conforms to the contours of an adult face, and is sized, in the preferred embodiment, to be about five inches wide at its widest and about 10 inches long. Returning now to FIGS. 1 and 2, cushion 16 has a generally U-shaped configuration, with the open end thereof facing towards the bed when BED 10 is in place. Cushion 16 may be attached to top portion 18 by any suitable fastener, such as snaps, or hook-and-loop fasteners. Cushion 16 thus substantially encircles the outer diameter of hole 20.

In this embodiment of the invention, a side portion 22 of head support element 14 extends downward at a 90 degree angle at one end of top portion 18 to connect to insert element 14. In this embodiment of the head support element, a pair of spaced-apart braces 24 are located between top portion 18 and side portion 22 to provide requisite rigidity. This construction is likely required when the BED is made of plastic materials. In the event that the BED is constructed of metal, such as aluminum, or aluminum composite matrix material, braces 24 are likely not required.

Insert element 14 includes a flat, horizontal portion 30 that is easily slid between a mattress and box springs of a bed. Horizontal portion 30 is also referred to herein as a second parallel surface. A vertical portion 32 of this embodiment of insert element 14 extends downward from one end of horizontal portion 30 at 90 degrees, and provides an attachment mechanism for head support element 12. Vertical portion 32 of insert element 14 has threaded bores 34 formed therein, which allow the fastening of side portion 22 of head support element 12 thereto by means of a fastener, such as threaded fasteners 36. The threaded bores are arranged in multiples sets so as to provide fastening of head support element 12 to insert element 14 to allow adjustability of the joined height of the elements. This adjustability allows for use of the BED with mattresses having different thicknesses. Other fastening mechanisms are well known to those of skill in the art, and may include a slide arrangement between the side portion and vertical portion with a locking mechanism, or an arrangement with multiple bores in one element and a conformal arrangement of dogs on the other, with a clamping mechanism to hold the two elements in a predetermined relationship between the parallel surfaces thereof.

Figure 4:
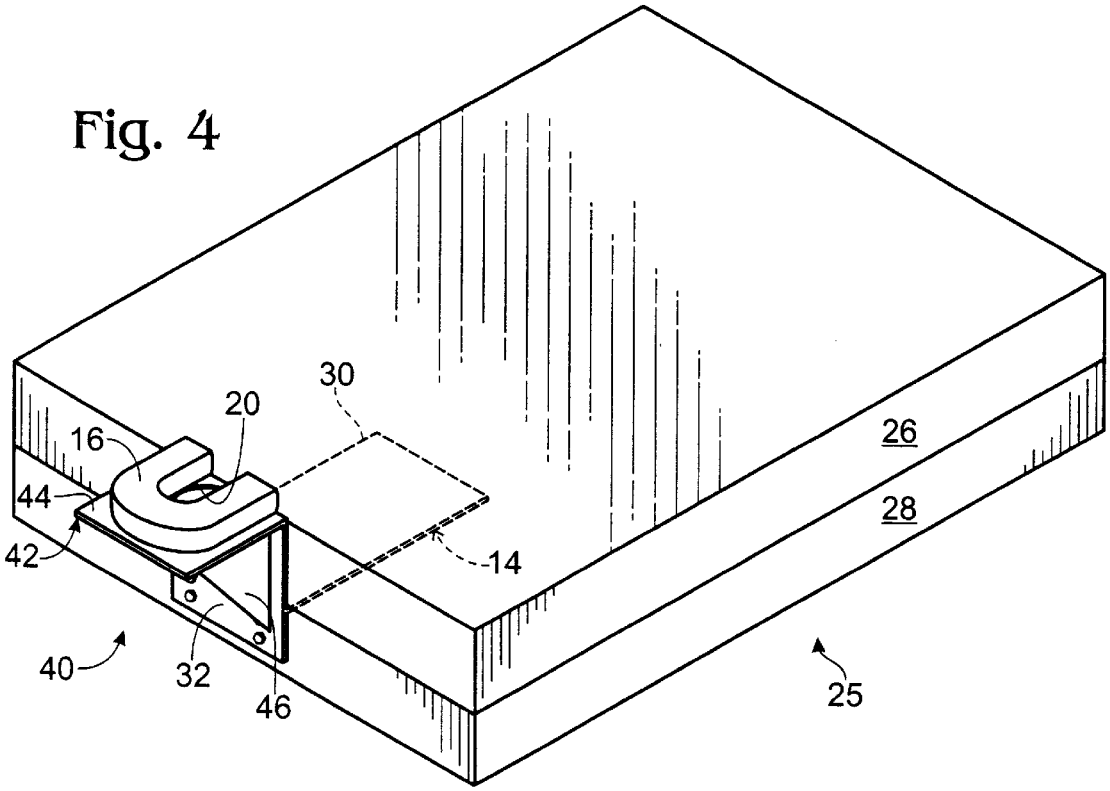
FIG. 4 is an environmental view of a second embodiment of the device of the invention.

Referring now to FIG. 4, a bed 25, having conventional mattress 26 and box-springs 28 is shown. A second embodiment of the bed extension device is shown generally at 40. Where structures are the same as in FIGS. 1–3, like reference numbers are used. A head support element 42 includes a top portion 44, which is constructed similarly to top portion 18, and includes a hole 20, and a side portion 46, having several bores formed therein. This embodiment, as previously noted, is likely made of a metal material, which does not require the uses of braces in the head support element.

Figure 5:
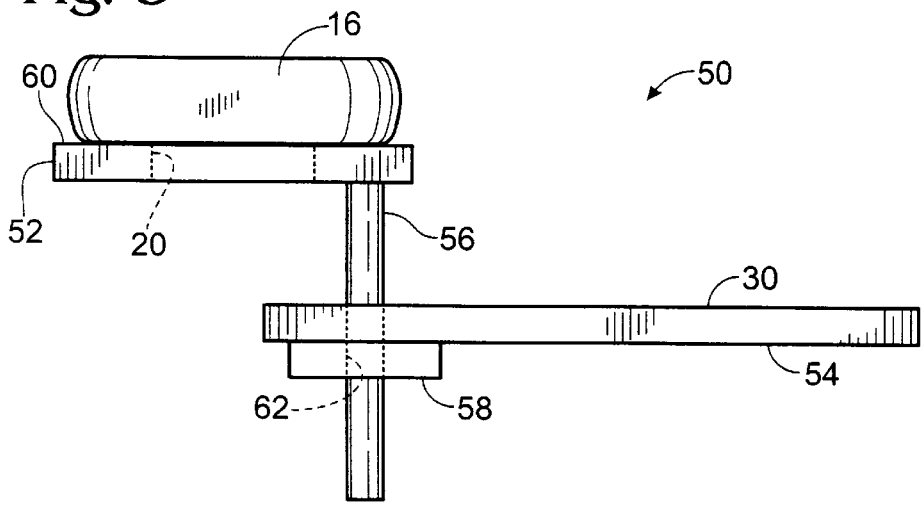
FIG. 5 is a side elevation of a third embodiment of the invention.

A third embodiment of the BED is shown generally at 50 in FIG. 5, and includes a head support element 52, and insert element 54, and at least one support pole 56, although it is preferred to use two support poles. A locking mechanism 58 is provided on insert element 54 to maintain a desired spatial relationship between head support element 52 and insert element 54.

Head support element 52 has a top portion 60, while support pole(s) 56 comprise a side portion thereto. Insert element 54 includes bore(s) 62 which is conformal to support pole(s) 56, and receives support pole(s) 56 therein. Bore(s) 62 comprise a vertical portion of insert element 54, while the upper surface thereof comprises a horizontal portion.

When properly connected, the head support element of either embodiment and insert element 14 form a structure having two, substantially parallel surfaces, top portion 18, 44 or 60, and horizontal portion 30, that are spaced-apart from one another by a variable distance. One surface is intended to be located under a mattress, while the other surface provides support for a patient's head while the patient lays on mattress 26. The relative distances between the top portion and the upper surface of the mattress may be adjusted to a predetermined relationship for optimum neck and spinal alignment, and to provide a desired alignment between the upper surface of mattress 26 and the top portion.

As depicted herein, in the preferred embodiments, the top portion has a substantially planar surface. The top portion may, however, be constructed to follow general contours of a human face to provide a cradle for the patient's face during massage. For storage and transport purposes, the head support element and the insert element may be detached from one another, which facilitates transport and storage.

The major advantage of this invention over prior art is that the bed extension device of the invention allows conversion of an existing bed surface for use as a massage table having an extended face/head rest. This invention negates the requirement that a separate massage table be purchased or transported to provide proper body alignment, including proper neck and spine alignment, during massage. This inexpensive invention simply requires slipping the horizontal portion of an insert element under a mattress to provide a base for a head support element, which in turns provides proper neck and spine alignment.

While this invention has been described in conjunction with a preferred embodiment thereof, modifications and changes may be made thereto without departing from the scope of the invention as defined by the claims appended hereto.

We claim:

1. A bed extension device for use with a conventional bed having a mattress with an upper surface and box springs, comprising:

a head support element having a planar, substantially solid top portion and a planar, solid side portion, wherein said top portion includes a hole therein and wherein said side portion is joined to said top portion at a substantially right angle;

an insert element having a planar, solid horizontal portion for insertion between the mattress and the box springs and a planar, solid vertical portion extending at a substantially right angle therefrom;

a fastener for securing said side portion of said head support element to said vertical portion of said insert element to provide a desired alignment between the upper surface of the mattress and said top portion; and a substantially U-shaped cushion for placement about said hole and fasteners for securing said cushion thereabout.

2. The device of claim 1 wherein said hole is generally conformal to the contour of an adult, human face.

3. The device of claim 1 wherein a brace extends from a lower surface of said top portion to said side portion to maintain a right-angle relationship therebetween.

4. The device of claim 1 wherein said side portion is joined to said top portion along a side thereof; and wherein said vertical portion is joined to said horizontal portion along a side thereof.

5. The device of claim 4 wherein said top portion is substantially parallel to said horizontal portion, and wherein said vertical portion includes multiple sets of threaded bores therein, wherein said side portion includes a set of bores therein, and wherein said fasteners are threaded and receivable in one of said multiple sets of threaded bores to provide a predetermined spacing between the parallel surfaces of said head support element and said insert element.

6. The device of claim 1 wherein said side portion includes at least one support pole extending downwardly adjacent an edge of said top portion; said vertical portion includes at least one bore conformal to said support pole; and wherein said fastener includes a locking mechanism for maintaining said top portion at a predetermined distance from said horizontal portion.

7. A bed extension device for use with a conventional bed having a mattress with an upper surface and box springs, comprising:

a head support element having a planar, substantially solid top portion and a planar, solid side portion, wherein said top portion includes a hole therein and wherein said side portion is joined to said top portion along one edge thereof at a substantially right angle, wherein said hole is generally conformal to the contour of an adult, human face;

an insert element having a planar, solid horizontal portion for insertion between the mattress and the box springs and a planar, solid vertical portion extending at a substantially right angle from one side of said horizontal portion;

fasteners for securing the side portion of said head support element to said vertical portion of said insert element to provide a desired alignment between the upper surface of the mattress and said top portion; and a substantially U-shaped cushion for placement about said hole and fasteners for securing said cushion thereabout, wherein said cushion is constructed and arranged to surround said hole about a majority of the periphery thereof.

8. The device of claim 7 wherein a brace extends from a lower surface of said top portion to said side portion to maintain a right-angle relationship therebetween.

9. The device of claim 7 wherein said top portion is substantially parallel to said horizontal portion, and wherein said vertical portion includes multiple sets of threaded bores therein, wherein said side portion includes a set of bores therein, and wherein said fasteners are threaded and receivable in one of said multiple sets of threaded bores to provide a predetermined spacing between the parallel surfaces of said head support element and said insert element.

10. A bed extension device for use with a conventional bed having a mattress with an upper surface and box springs, comprising:

a head support element having a planar, substantially solid top portion and a planar, solid side portion, wherein said top portion comprises a first parallel surface and includes a hole therein and wherein said side portion is joined to said top portion along one edge thereof at a substantially right angle, wherein said side portion includes a set of bores therein;

an insert element having a planar, solid horizontal portion, which comprises a second parallel surface, for insertion between the mattress and the box springs and a planar, solid vertical portion extending at a substantially right angle from one side of said horizontal portion, wherein said vertical portion includes multiple sets of threaded bores therein;

threaded fasteners for securing the side portion of said head support element to said vertical portion of said insert element to provide a desired alignment between the upper surface of the mattress and said top portion, wherein said threaded fasteners are receivable in one of said multiple sets of threaded bores to provide a predetermined spacing between said first parallel surface and said second parallel surface; and a substantially U-shaped cushion for placement about said hole and fasteners for securing said cushion thereabout, wherein said cushion is constructed and arranged to surround said hole about a majority of the periphery thereof and is sized to be located within the margins of said top portion.

11. The device of claim 10 wherein said hole is generally conformal to the contour of an adult, human face.

12. The device of claim 10 wherein a brace extends from a lower surface of said top portion to said side portion to maintain a right-angle relationship therebetween.

* * * * *